United States Patent [19]

Legris

[11] 4,356,936

[45] Nov. 2, 1982

[54] REMOTE-CONTROLLED VALVES FUNCTIONING BY PERCUSSION

[75] Inventor: Andre Legris, Saint Maur, France

[73] Assignee: Legris, Rennes, France

[21] Appl. No.: 154,106

[22] Filed: May 28, 1980

[30] Foreign Application Priority Data

May 30, 1979 [FR] France ..... 79 13886
Apr. 14, 1980 [FR] France ..... 80 08306

[51] Int. Cl.[3] ..... B67B 7/24

[52] U.S. Cl. ..... 222/5; 169/19; 441/99

[58] Field of Search ..... 222/5, 81, 83.5, 88; 9/324, 325, 318; 169/19, 20, 26; 137/68 R

[56] References Cited

U.S. PATENT DOCUMENTS 3,008,479 11/1961 Mancusi ..... 222/5
3,048,303 8/1962 Spidy et al. ..... 222/5
3,526,339 9/1970 Bernhardt et al. ..... 222/5
3,757,371 9/1973 Martin ..... 222/5
3,934,292 1/1976 Mulderrig ..... 222/5
4,083,187 4/1978 Nagashima ..... 222/5

*Primary Examiner*—H. Grant Skaggs
*Attorney, Agent, or Firm*—Bucknam and Archer

[57] ABSTRACT

A valve that is connected to a container of pressurized fluid and has a spring-loaded striker member which is normally secured in a ready position out of contact with a seal retaining the fluid within the container, the striker member being releasable by the action of a releasable lock for movement by a loading spring into an operate position in which the striker member perforates the seal to release the pressurized fluid. The lock is responsive to a control member to lock the striker member against movement when the control member is in a non-operating position, and to release the striker member upon arrival of the control member at an operating position. Movement of the control member is effected by a releasable connector which connector is further responsive to the arrival of the control member at the operating position to then release the cable allowing the escape thereof.

16 Claims, 6 Drawing Figures

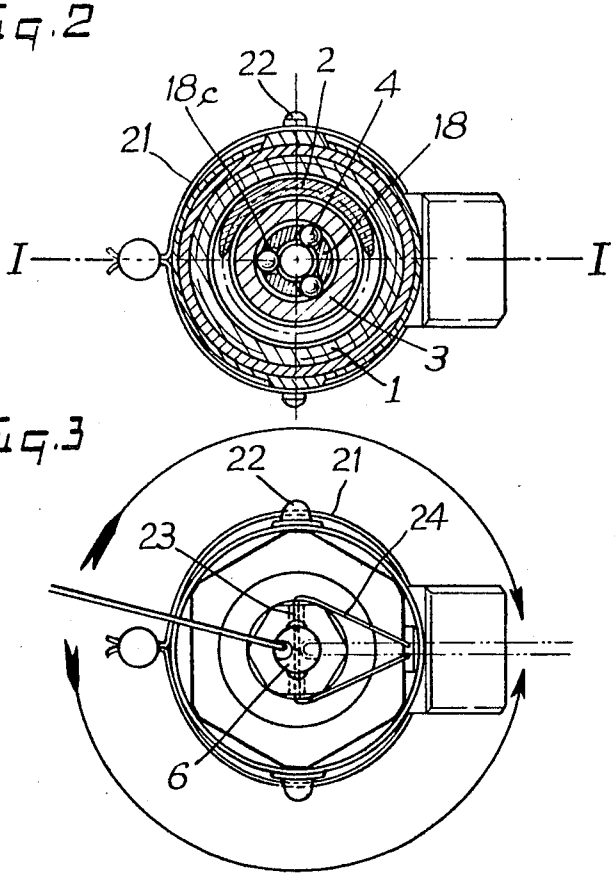
FIG. 2
FIG. 3
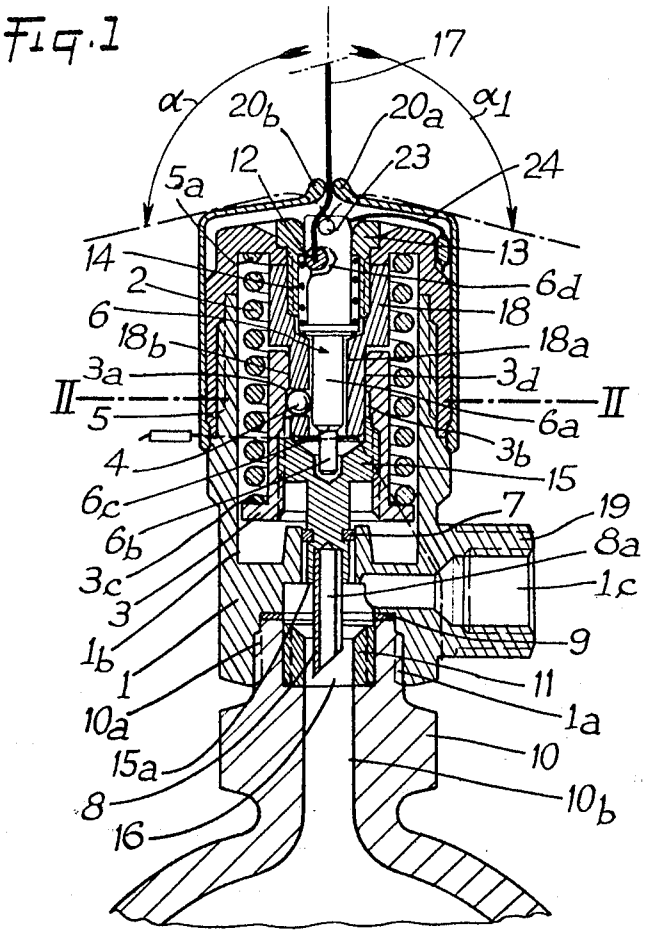
FIG. 1

REMOTE-CONTROLLED VALVES FUNCTIONING BY PERCUSSION

The present invention relates to an improved valve of the type having a spring-loaded striker or percussion member which is normally secured in a ready position and releasably locked thereat out of contact with a seal retaining pressurized fluid within a container, and which striker member upon release perforates the seal to release the pressurized fluid.

Valves of this type find many applications, particularly wherever pressurized fluid is to be utilized for inflating a life raft, tires, actuating jacks, spraying powder or paint, washing under pressure, and many other uses.

The device according to the invention may therefore be employed in the domains mentioned hereinabove, but more particularly in the domain of life-saving at sea and the inflation of pneumatic safety rafts. These rafts are inflated with carbon dioxide or other gas, for example nitrogen or a gaseous mixture, via a valve functioning by percussion, acting on the diaphragm of a hermetically sealed bottle or the like.

Furthermore, the device is necessarily remote-controlled, since the raft must necessarily be in the water before being inflated.

Other devices comprise a lever which gears down the force exerted on a handle and transmit it to the percussion member. Devices comprising a progressive rocking cam procure the same final result. It is also known to use devices comprising a rotary cam which act by pushing the striker member.

In known devices comprising a spring, the tensioning is sometimes effected by a pin, but in this case re-setting is difficult.

Certain other spring devices also comprise a locking employing balls and the percussion member is released when the balls retract in oblique housings.

The major drawback of such a device resides in that there is a possibility of jamming of the balls which are in contact with one another in these oblique housings and which may annul any action of the spring on the striker member whose functioning is rendered impossible. In all devices comprising a spring striker member, the percussion action is direct, i.e. the manual effort for actuating the percussion member is exerted on the spring for setting the percussion in motion. Now, this spring always presents a large resistance, and the operator must furnish a corresponding effort to release the members locking the percussion member. Pyrotechnic devices are also known which launch the striker member, but they are complex and are not entirely safe. Now, a total reliability is necessary, particularly when the device is used for life-saving at sea.

None of the existing devices really satisfies the conditions required in the case of a control of the device by cable. In fact, in this case, the device must be actuated, whatever the orientation of the cable, with a weak force on the remote control, for temperatures ranging between −30° C. and +66° C., in a corrosive marine medium (salt, sand). Reliability must remain total after several years of ageing of the apparatus.

The same requirements of smoothness and reliability are required in the case of remote servo-controls.

It is an object of the present invention to avoid the drawbacks of the existing devices and to strictly satisfy the very difficult conditions mentioned above.

In accordance with the present invention, the cover receives a tubular guide member extending inside the body and presenting a bore in which is slidably mounted a control rod connected by its upper part to an escape means fast with a manoeuvring cable, said guide member externally comprising a cylindrical portion on which is slidably mounted a percussion member subjected to the action of a main spring in abutment against the cover, said tubular guide member comprising radial housings in which balls are radially maintained prisoner, which balls are in abutment, in locked position, under the action of the spring, against a conical portion of the percussion member and against the portion of the control rod of largest section and, in unlocked position, against the portion of the control rod of reduced section.

In the valve according to the invention, the striker device may be controlled with a very moderate manual effort. The shapes, designs and materials used make it possible to avoid all the mechanical causes of poor functioning. The manual actuation and simplicity of the device used enable the process of functioning to be carried out in complete safety and with total reliability.

The moderate tractive force exerted on the supple cable allows the latter to be oriented in directions forming a cone, whilst also allowing it a rotation on itself via the control rod. All these possibilities render the control multi-directional.

The invention will be more readily understood on reading the following description with reference to the accompanying drawings, in which:

FIG. 1 is a view in elevation and in longitudinal section of an embodiment of the valve according to the invention in tensioned position before percussion.

FIG. 2 is a view in section along line II—II of FIG. 1.

FIG. 3 is a plan view of the valve shown in FIG. 1.

Figure 5:
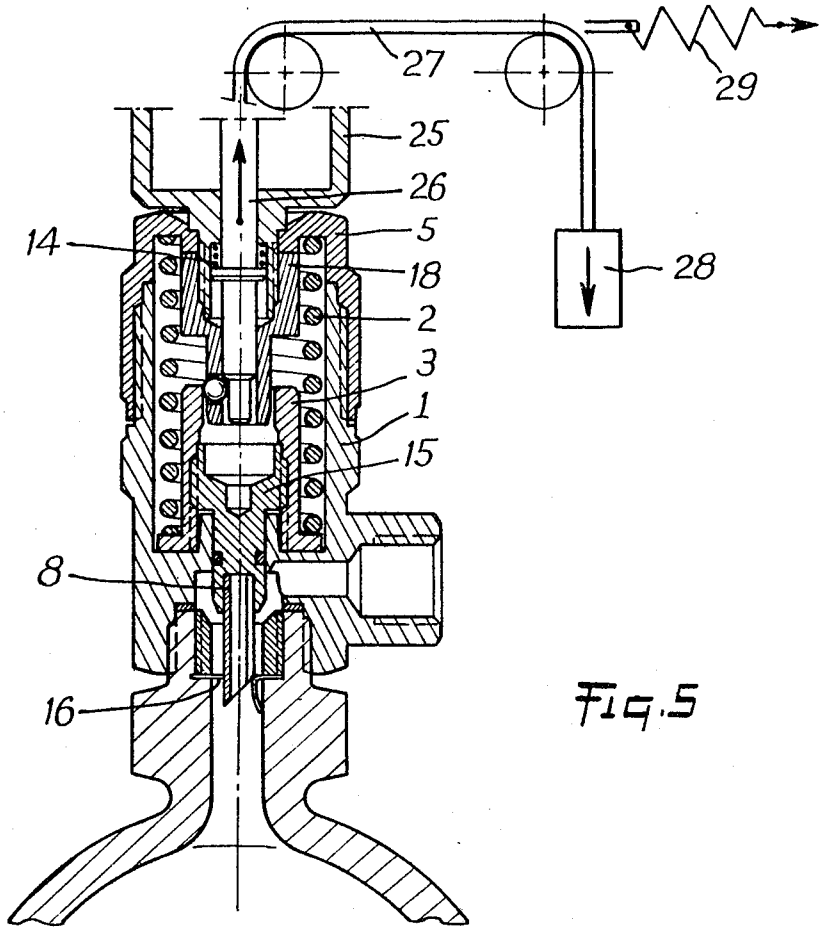
FIG. 5 is a view in elevation and in longitudinal section of an embodiment of the valve controlled by an automatic servo-controlled drive means.
Figure 4:
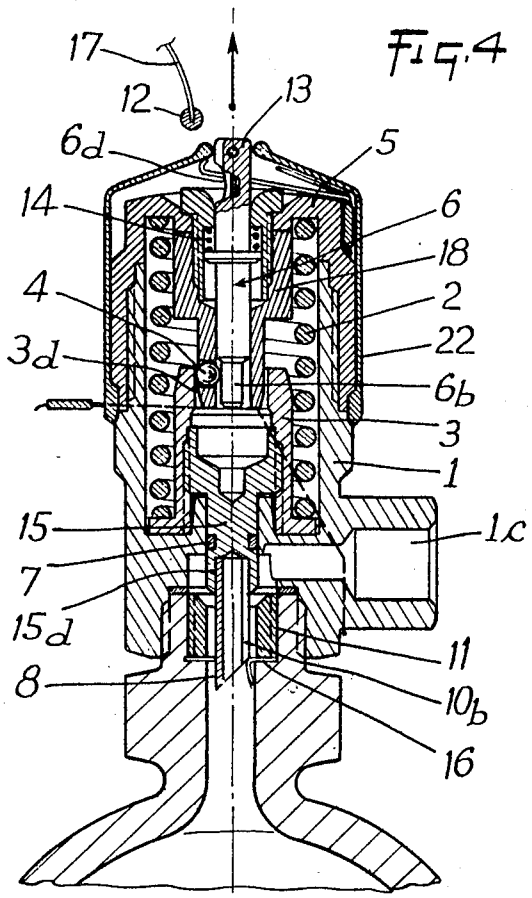
FIG. 4 is a view in elevation and in longitudinal section of the valve in position of percussion.

Referring now to the drawings, FIGS. 1,2,3,4 show an embodiment of a valve according to the invention comprising a body 1 presenting a tapped hole 1*a* by which it is screwed, with interposition of an O-ring 9, on a corresponding threaded portion of the tube 10*a* for passage of the fluid from a sealed bottle 10 of pressurised fluid. In the tube 10*a* of the bottle there is disposed a diaphragm 16 closing the fluid conduit 10*b*, said diaphragm 16 being maintained by a threaded ring 11 screwed in the tube 10*a* of the bottle which is of standard type. The body 1 comprises an outlet conduit 1*c* at right angles and a tube 19 presenting a threaded portion in which is screwed a member for connection to a user circuit for the fluid ensuring the conveying of the pressurised fluid after the diaphragm 16 has been pierced (FIGS. 4 and 5).

In its upper part, the body 1 is provided with a cylindrical housing 1*b* closed by a cover 5 screwed on the body 1 and on which is fixed, via a screwed sleeve 13, a tubular guide member 18 extending inside the body 1 and presenting a bore 18*a* in which is slidably mounted a control rod 6 presenting in its upper part which extends in the sleeve 13 a housing 6*d* in which is engaged, in tensioned position, a spherical member 12 fast with a manoeuvring cable 17.

Said member remains fast with the rod 6 (FIG. 1) during part of the stroke where it is prisoner in the housing 6*d* and then it escapes from said housing (FIG. 4), releasing the cable 17.

In its lower part, the rod 6 present a cut portion 6*b* of section smaller than that of the median part 6*a* which slides in the bore 18*a*, the portions 6*a* and 6*b* being connected by a conical portion 6*c*.

In the sleeve 13 there is provided a recess in which is mounted, around the upper part of the rod 6, a spring 14 which has two main functions:

to maintain in locked position the control rod 6 against any untimely manoeuvre.

to promote the re-setting of the whole after percussion.

The guide member 18 externally presents a cylindrical portion 18*b* on which is slidably mounted a percussion member constituted by a sleeve 3 comprising in its upper part, sliding against the guide member 18, a recess 3*b* with a control portion 3*a*, said sleeve 3 presenting a tapped bore in which is screwed an endpiece 15 on which is fixed, at its end, a striker member 8 provided with a sharp, bevelled point, so as to pierce the diaphragm 16 when the striker member is in low position (FIG. 4), said striker member presenting a conduit 8*a* connecting the hollow point to the outlet conduit 1*c* for the fluid for the percussion position.

In its lower part, the sleeve 3 is provided with a shoulder 3*c* against which abuts one of the ends of a main spring 2 in abutment by its other end against the bottom 5*a* of the cover 5.

The tubular guide member 18 is provided with cylindrical housings 18*c* in which balls 4 are radially maintained prisoner, which balls are in abutment in locked position (FIG. 1) under the action of the spring 2 against a conical portion 3*a* of the sleeve 3 and against the portion 6*a* of the rod 6 of largest section. In unlocked position, the balls 4 are in abutment against the portion 6*b* of reduced section of the control rod 6. The balls 4 have a diameter greater than the radial length of the housings 18*c* so that the balls project in the recess 3*b* of the sleeve 3 when the device is in locked position and in the portion comprised between the bore 18*a* of the guide member 18 and the part 6*b* of the rod of reduced section when the device is in unlocked position.

In order to facilitate movement of the cable 17 in all directions, it is also possible to use a rod 6 composed of two parts mounted to pivot with respect to each other, so that the lower part maintained tightened by the balls 4 does not prevent the rotation of the upper part fast with the cable 17. Due to the use of the valve under conditions in which it is subjected to corrosion of the marine environment and to prevent any penetration of water or foreign bodies which may be detrimental to the reliability of the functioning of the whole, the body 1 is provided with a supple sheath 20 provided with an orifice 20*a* for passage of the manoeuvring cable 17 and the rod 6, said sheath presenting around the orifice 20*a* a circular bead 20*b* and in its upper part a conical form of large angle $\alpha,\alpha$ 1 for the movement of the manoeuvring cable.

In its lower part, the supple sheath 20 is provided with a lead wire 21 engaged in bosses 22 provided on the sheath and driving the body 1 and the tube 19.

Similarly, the rod 6 is provided in its upper part with a hole 23 in which is engaged a lead wire 24 to avoid any untimely manoeuvre apart from the control by the cable 17.

The valve according to the invention functions as follows:

The different members of the valve being in the position shown in FIG. 1, all the leaded release members and the striker member 8 in high position at a certain distance from the diaphragm 16, a traction is exerted on the cable 17 which causes the upward displacement of the control rod 6 whose stroke allows the disengagement of the balls 4 in the portion 6*b* of the rod 6 and the disengagement of the spherical member 12, 6*d* allowing the release of the cable 17 and its separation from the valve. The balls 4 no longer being in contact with the conical portion 3*a* of the sleeve 3, the main spring 2 may instantaneously release its potential energy by causing the sleeve 3 to slide along its bore 3*d* about the balls 4 which are pushed in the space between the bore 18*a* and the part 6*b* of the control rod 6. The striker member 8 with hollow point fast with the endpiece 15, itself fixed to the sleeve 3, perforates the diaphragm 16 (FIG. 4) and places the interior of the bottle 10 in communication with the conduit 1*c* of the fluid.

After the cable 17 has escaped, the control rod 6 remains in contact by its conical portion 6*c* against the balls 4 under the action of the spring 14.

To return the valve into high, re-set position, the following prior operations must be carried out:

unscrewing of the valve from the bottle 10 by means of the thread 10*a*, returning into position of the spherical member 12 fast with the cable 17 in the housing 6*d* of the control rod 6.

When these operations have been carried out, it suffices to push the base 15*a* of the endpiece 15 to reset the valve by compressing the spring 2, so that the balls 4 are pushed by the portion 6*a* of the rod 6 in the recess 3*b* of the sleeve and come into abutment against the conical portion 3*a* of the sleeve 3 after it has risen. This resetting necessitating a great deal of energy, it is necessary to use a jack or any other mechanical means and to carry out this operation in a specialized workshop.

After re-setting, the safety lead wires are returned into position and the valve is ready for use again.

FIG. 5 shows a variant embodiment of the valve in which the manual drawing of the traction cable has been replaced by a servo-controlled, motorised means.

In the case of FIG. 5, the driven member 25 is a jack using a hydraulic or pneumatic fluid in which the rod 6 has been replaced by a rod 26 fast with a piston (not shown in the drawing).

The drive member is remotely controlled by acting on the fluid used or on the electric current in the case of an electro-valve. The release effort required being very low, the drive members used are very small and consequently highly economical.

According to another variant, a supple cable 27 used for a manual emergency control is subjected to a permanent tension, ensured either by a light weight 28 or by a spring 29.

The remote-controlled valves functioning by percussion according to the invention may be used in the case of a bottle or sealed circuit of pressurised fluid, comprising a diaphragm which must be perforated to allow the fluid to leave.

These valves may be used for the following uses, without the list being limitative.

In the domain of safety and life-saving, the device may be used for inflating pneumatic rafts, the remote control of fire extinguishers, the emergency decompression of a circuit of dangerous fluid, the manoeuvre by a fluid stored under pressure of different equipment (valves, gates, air-locks, dams, etc . . . ).

Apart from this domain, the device may be used as means for remotely manoeuvring a fluid for occasional control or for repair for different equipment (jacks, inflation of tyres, atomization, powdering, washing under pressure, painting etc . . . ).

It is also possible to use the valve according to the invention with sealed bottles adapted to furnish a normal drive fluid.

Figure 6:
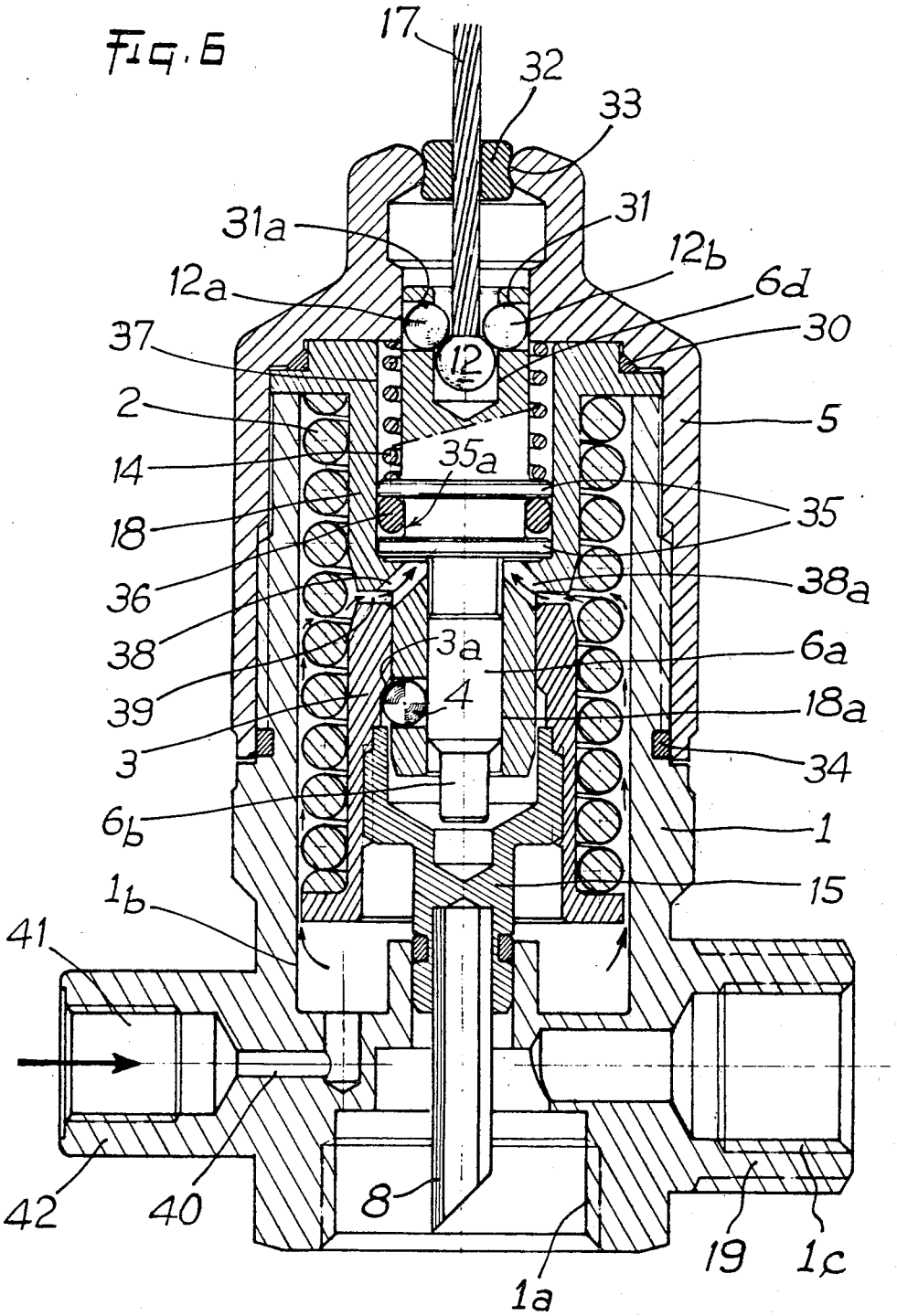
FIG. 6 is a view in axial section of an embodiment of an improved valve functioning by percussion.

The embodiment of the valve functioning by percussion shown in FIG. 6 comprises a body 1 presenting a tapped hole 1*a* by which it is screwed on a corresponding threaded portion of the tube for the passage of the fluid from a sealed bottle of fluid under pressure. The body 1 comprises an outlet conduit 1*c* at right angles and a tube 19 presenting a threaded portion on which is screwed a member for connection to a user circuit of the fluid ensuring the conveying of the fluid under pressure after percussion of the diaphragm.

In its upper part, the body 1 presents a cylindrical housing 1*b* closed by a cover 5 screwed on the body 1 with interposition of an O-ring 34, and on which abuts, with interposition of an O-ring 30, a tubular guide member 18 extending inside the body 1 and presenting a bore 18*a* in which is slidably mounted a control rod 6 provided in its upper part with a housing 6*d* in which is engaged, in tensioned position, a spherical member 12 fast with a manoeuvring cable 17.

Said spherical member 12 is maintained in the housing 6*d* by balls 12*a*, 12*b*, disposed in bores 31, 31*a* in the control rod 6. The cable 17 is guided in a circular O-ring 32 disposed in an orifice 33 provided in the upper part of the cover 5. At its upper part, the control rod 6 comprises a piston 35 provided with a groove 35*a* in which an O-ring 36 is disposed, said piston being slidably mounted in a cylindrical housing 37 in the guide member 18 against the action of a secondary spring 14 in abutment against the cover 5. In the bottom of the cylindrical housing 37 open out conduits 38, 38*a* pierced in the guide member 18 and which are in communication with the cylindrical housing 1*b* of the body by a space 39 provided between the guide member 18 and the sleeve 3.

In its lower part, the housing 1*b* of the body is in communication by a conduit 40 with a tapped hole 41 of a tube 42 fast with the lower portion of the body, the tapped hole 41 being adapted to receive the head of a pyrotechnic gas cartridge (not shown in the drawing) of known type.

The percussion means constituted by the sleeve 3 on which abuts the main spring 2 and which is connected to the striker member 8 by an endpiece 15, are identical to those mentioned hereinabove. Similarly, the locking means comprising the balls 4 which cooperate with the rod 6, the sleeve 3 and the guide member 18 is identical to the above-mentioned one.

The device according to FIG. 6 functions as follows:

When the pyrotechnic cartridge is perforated, the pressurised gas coming from the cartridge escapes through the conduit 3 into the cylindrical housing 1*b* of the body 1 which it fills, so that the gas taking up the space 39 and the conduits 38, 38*a* fills the space between the bottom of the housing 37 and one of the faces of the piston 35 which is pushed upwardly, compressing the secondary spring 14.

The upward displacement of the control rod 6 allows the radial displacement of the balls 4 which are no longer in contact with the conical portion 3*a* of the sleeve 3, and the main spring 2 which is released may act on the sleeve 3 in order that said latter slides on the guide member 18 and drives the endpiece 15 bearing the strike member 8 which perforates the diaphragm of the compressed air bottle whose interior is placed in communication with the conduit 1*c*. The same result may be obtained by exerting a traction on the cable 17, which causes the upward displacement of the control rod 6 and, consequently, the unlocking of the sleeve 3 and the lowering of the striker member 8 for perforating the diaphragm.

From the foregoing description of preferred imbodiments of the invention, the artisan will understand that the striker member can be considered either as the piercing tube 8 or as the combination of such tube 8 plus the other parts of the valve that move in unison therewith, including the sleeve 3 and its endpiece 15.

Various modifications may of course be made by the man skilled in the art to the devices or methods which have just been described solely by way of non-limiting example, without departing from the scope of the invention.

What is claimed is:

1. In a valve functioning by percussion, mounted on a container of fluid under pressure, utilizing a closure diaphragm adapted to be perforated by a striker member in order to release the pressurised fluid, said striker member being mounted in a body closed by a cover and secured to said container, an improvement which comprises a tubular guide member mounted on the cover, extending inside the body and presenting a bore in which is slidably mounted a control rod connected by a releasable connector means to an operating cable for movement thereby from a non-operate position into an operating position in which said connector means releases to allow escape of said cable, said guide member being provided with an external cylindrical portion on which is slidably mounted a percussion member that drives a striker member and is subjected to the preload action of a main spring in abutment against the cover, said tubular guide member comprising radial housings, a plurality of balls captively retained each within a corresponding one of said radial housings, each ball being normally held, under the action of said spring, in a locked position of abutting engagement against a conical portion of said percussion member and against a given diameter section of said control rod to thereby lock the percussion member against movement by said spring and thus prevent the striker member from perforating said closure diaphragm, each ball being moveable in the corresponding radial housing in response to the arrival of the control rod at said operating position, into an unlocked position of abutting engagement against a reduced diameter section of the control rod, each ball when in said unlocked position releasing said percussion member for movement by said spring to drive said striker member into a position perforating said closure diaphragm.

2. The improved valve of claim 1, wherein the balls have a diameter greater than the radial length of said radial housings, each ball projects into a recess in the percussion member when the ball is in said locked position and each ball is received in a space between the bore of the guide member and said reduced diameter section of the control rod, when the ball is in said unlocked position.

3. The improved valve of claim 1, wherein the control rod is subjected to the action of a secondary spring in abutment against the bottom of a recess in the cover, said secondary spring ensuring the maintaining of the control rod in said non-operate position to thereby maintain said balls in their respective locked positions.

4. The improved valve of claim 1, wherein said reduced diameter section of the control rod is connected to said given diameter section thereof by a conical portion which cooperates with the balls to facilitate moving said balls to their locked positions to reset the control rod to its non-operate position.

5. The improved valve of claim 1, wherein the percussion member is constituted by a sleeve slidably mounted on the guide member and comprising a recess with a conical portion for supporting the balls, said sleeve comprising an endpiece on which the striker member is fixed, said endpiece comprising an O-ring between a chamber of the valve and a conduit for passage of the fluid.

6. The improved valve of claim 1, wherein there is disposed on the body of the valve a supple sheath provided with an orifice for passage of the operating cable and the control rod, said sheath having a circular bead provided around said orifice and accommodating the pulling of the control rod from its non-operating position to its operating position with the operating cable extending along any direction within a given cone.

7. The improved valve of claim 6, wherein the supple protective sheath is secured by a wire about the body of the valve and its tube.

8. The improved valve of claim 1, wherein the control rod is provided with a hole in which a wire is mounted to secure the control rod in its non-operate position.

9. The improved valve of claim 1, wherein the control rod is composed of two parts, one part of which is connected to the operating cable being pivotal about an axis.

10. The improved valve of claim 1, wherein said operating cable is wound in a tensioned non-operating position, and which is pulled into an operating position, and including tensioning means acting on said cable.

11. The improved valve of claim 1, wherein the control rod is provided with a piston which is in communication, on its face opposite the one subjected to the action of a secondary spring, with at least one conduit connected to a pyrotechnic cartridge containing a gas under pressure which, when it is released, pushes said piston against the secondary spring and releases the percussion member after retraction of the balls into their unlocked positions.

12. The improved valve of claim 1, wherein the body is provided at its base with a tapped hole in which is screwed a pyrotechnic gas cartridge, said tapped hole being extended by a conduit opening in a cavity defined inside the body which is in communication by a space provided between the tubular guide member and the percussion member, with at least one conduit opening at the base of a cylindrical housing provided in the tubular guide member and on one of the faces of a piston carried by the control rod.

13. The improved valve of claim 1, including a piston, mounted to slide in a cylindrical housing of the tubular guide member, said piston being provided with a circular groove in which an O-ring is disposed.

14. The improved valve of claim 1, including O-rings provided on the cover, the body and the tubular guide member respectively.

15. The improved valve of claim 1 including a drive member connected to the control rod and which is actuated by a remote-controlled electrical means.

16. The improved valve of claim 1 including a drive member connected to the control rod and which is actuated by a manual control including a cable.

* * * * *